US011695228B2

(12) United States Patent
Tanaka et al.

(10) Patent No.: US 11,695,228 B2
(45) Date of Patent: Jul. 4, 2023

(54) CONNECTOR

(71) Applicant: Japan Aviation Electronics Industry, Limited, Tokyo (JP)

(72) Inventors: Yukitaka Tanaka, Tokyo (JP); Yuki Suda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 64 days.

(21) Appl. No.: 17/407,308

(22) Filed: Aug. 20, 2021

(65) Prior Publication Data

US 2022/0115799 A1 Apr. 14, 2022

(30) Foreign Application Priority Data

Oct. 12, 2020 (JP) ..... 2020-171682
Oct. 12, 2020 (JP) ..... 2020-171688

(51) Int. Cl.
*H01R 12/70* (2011.01)
*H01R 12/71* (2011.01)
*H01R 13/627* (2006.01)
*H01R 12/79* (2011.01)

(52) U.S. Cl.
CPC ..... *H01R 12/716* (2013.01); *H01R 12/7005* (2013.01); *H01R 12/79* (2013.01); *H01R 13/6273* (2013.01); *H01R 13/6275* (2013.01)

(58) Field of Classification Search
CPC .. H01R 12/716; H01R 12/7005; H01R 12/79; H01R 13/6273; H01R 13/6275; H01R 13/6594
See application file for complete search history.

(56) References Cited

U.S. PATENT DOCUMENTS 10,069,244 B2 9/2018 Neu et al.
10,601,181 B2 3/2020 Lu et al.
11,527,854 B2 * 12/2022 Peloza ..... H01R 13/6587
(Continued)

FOREIGN PATENT DOCUMENTS

TW M595343 U 5/2020

OTHER PUBLICATIONS

Taiwanese Office Action in corresponding Taiwanese Patent Application No. 110131235 dated Nov. 24, 2022 with English translations thereof.

*Primary Examiner* — Abdullah A Riyami
*Assistant Examiner* — Nelson R. Burgos-Guntin
(74) *Attorney, Agent, or Firm* — Collard & Roe, P.C.

(57) ABSTRACT

A housing of a connector has end faces at both ends thereof in a pitch direction. The end faces correspond to protruding blocks of a mating connector 50, respectively. Two guide members are distinct and separated from each other. Each of the guide members has a side portion and two supporting portions. The guide members correspond to the end faces, respectively. Accordingly, the side portion and the supporting portions correspond to one of the end faces. The side portion is located apart from the end face corresponding thereto in the pitch direction. The side portion, the supporting portions and the end face corresponding to the side portion form a receiving portion. The receiving portion guides and receives the protruding block corresponding to the end face forming the receiving portion when the connector and the mating connector are mated with each other.

5 Claims, 11 Drawing Sheets

(56) References Cited

U.S. PATENT DOCUMENTS

| | | | | |
|---|---|---|---|---|
| 2009/0170357 | A1* | 7/2009 | Yamashita | H01R 12/707 439/157 |
| 2015/0044901 | A1* | 2/2015 | Doi | H01R 12/716 439/592 |
| 2015/0044914 | A1* | 2/2015 | Kimura | H01R 13/41 439/733.1 |
| 2015/0270658 | A1* | 9/2015 | Aoki | H01R 12/716 439/660 |
| 2020/0083627 | A1* | 3/2020 | Peloza | H01R 13/6587 |
| 2021/0028563 | A1* | 1/2021 | Gross | H01R 13/28 |
| 2021/0075159 | A1* | 3/2021 | Wang | H01R 13/6582 |
| 2021/0126404 | A1* | 4/2021 | Laurx | H01R 12/716 |
| 2021/0167535 | A1* | 6/2021 | Tanaka | H01R 12/79 |
| 2021/0305751 | A1* | 9/2021 | Chen | H01R 13/629 |
| 2021/0328383 | A1* | 10/2021 | Kimura | H01R 24/60 |
| 2021/0408727 | A1* | 12/2021 | Fan | H01R 13/639 |
| 2022/0021143 | A1* | 1/2022 | Obata | H01R 12/91 |
| 2022/0115799 | A1* | 4/2022 | Tanaka | H01R 12/716 |

* cited by examiner

CONNECTOR

CROSS REFERENCE TO RELATED APPLICATIONS

This application is based on and claims priority under 35 U.S.C. § 119 to Japanese Patent Application No. JP2020-171688 filed Oct. 12, 2020 and No. JP2020-171682 filed Oct. 12, 2020, the contents of which are incorporated herein in their entirety by reference.

BACKGROUND OF THE INVENTION

The present invention relates to a connector to be mounted on a substrate, in particular, to a connector provided with a guide member for guiding a mating connector.

U.S. Pat. No. 10,601,181 (Patent Document 1) discloses an example of a connector to be mounted on a substrate, wherein the connector has a guide member. As understood from FIG. 17, a connector 90 of Patent Document 1 is mounted on an upper surface of a substrate (not shown) in an up-down direction and mateable with and detachable from a mating connector 95.

As shown in FIG. 17, the mating connector 95 has a terminal board 951 and an adjacent wall 953. Each of the terminal board 951 and the adjacent wall 953 protrudes downward in the up-down direction. The terminal board 951 is provided with a plurality of mating contacts (not shown). The adjacent wall 953 is located near the terminal board 951 to be apart therefrom in a direction perpendicular to the up-down direction.

As shown in FIG. 17, the connector 90 has an insulator body (housing) 92 and a metal housing (guide member) 94. The insulation body 92 defines a receiving space 921 which receives the terminal board 951 of the mating connector 95. The receiving space 921 opens upward. The insulation body 92 holds a plurality of contacts 923. Each of the contacts 923 is exposed in the receiving space 921 in part. The metal housing 94 surrounds the insulation body 92 in a plane perpendicular to the up-down direction. The metal housing 94 defines an adjacent groove 941 which receives the adjacent wall 953 of the mating connector 95 together with a side surface of the insulation body 92. The metal housing 94 is provided with a plurality of leg portions 943 which is fixed to the substrate when the connector 90 is mounted on the substrate (not shown).

SUMMARY OF THE INVENTION

In the connector 90 of Patent Document 1, the metal housing 94 is exclusively designed for the insulation body (housing) 92 having a particular shape and a particular size. Accordingly, the metal housing 94 cannot be combined with a housing different from the insulation body 92 in shape or size. For example, the metal housing 94 cannot be combined with a housing provided with contacts of which number is different from the number of the contacts 923 of the insulation body 92. In other words, a structure of the connector 90 of Patent Document 1 prevents from achieving parts commonality for connectors of plural types.

It is therefore an object of the present invention to provides a connector with a structure suitable for parts commonality.

One aspect of the present invention provides a connector which is mateable with a mating connector along an up-down direction. The connector is to be mounted on a substrate in the up-down direction. The mating connector comprises a plurality of mating contact portions and two protruding blocks. The protruding blocks protrude along the up-down direction. The protruding blocks are located apart from each other in a pitch direction perpendicular to the up-down direction. Each of the protruding blocks is provided with a mating locking portion. The connector comprises a plurality of terminals, a housing, two guide members and two locking portions. The terminals correspond to the mating contact portions, respectively. Each of the terminals has a contact portion which is brought into contact with the mating contact portion corresponding thereto in a mated state that the connector and the mating connector are mated with each other. The housing holds the terminals. The terminals are arranged in the pitch direction. The housing has end faces at both ends thereof in the pitch direction. The end faces correspond to the protruding blocks, respectively. The locking portions lock the mated state together with the mating locking portions. The guide members are distinct and separated from each other. Each of the guide members has a side portion and two supporting portions supporting the side portion. The guide members correspond to the end faces, respectively, and thereby the side portion and the supporting portions correspond to one of the end faces. The side portion is located apart from the end face corresponding thereto in the perpendicular direction. The side portion, the supporting portions and the end face corresponding to the side portion form a receiving portion. The receiving portion guides and receives the protruding block corresponding to the end face forming the receiving portion when the connector and the mating connector are mated with each other.

The connector of the present invention is provided with the housing and the two guide members. The guide members are distinct and separated from each other and correspond to the end faces at the both ends of the housing. Each of the guide portions has the side portion and the two supporting portions. The side portion and the two supporting portions form the receiving portion together with the end face corresponding thereto. The receiving portion guides and receives the protruding block of the mating connector. Since the guide members are disposed to correspond to the end faces at the both ends of the housing, the guide members can be attached to the housing without limiting by the shape of the housing and the size of the housing. In other words, the guide members are attachable to any one of housings with various shapes and sizes. Thus, the present invention can provide a connector with a structure suitable for parts commonality.

An appreciation of the objectives of the present invention and a more complete understanding of its structure may be had by studying the following description of the preferred embodiment and by referring to the accompanying drawings.

Figure 1:
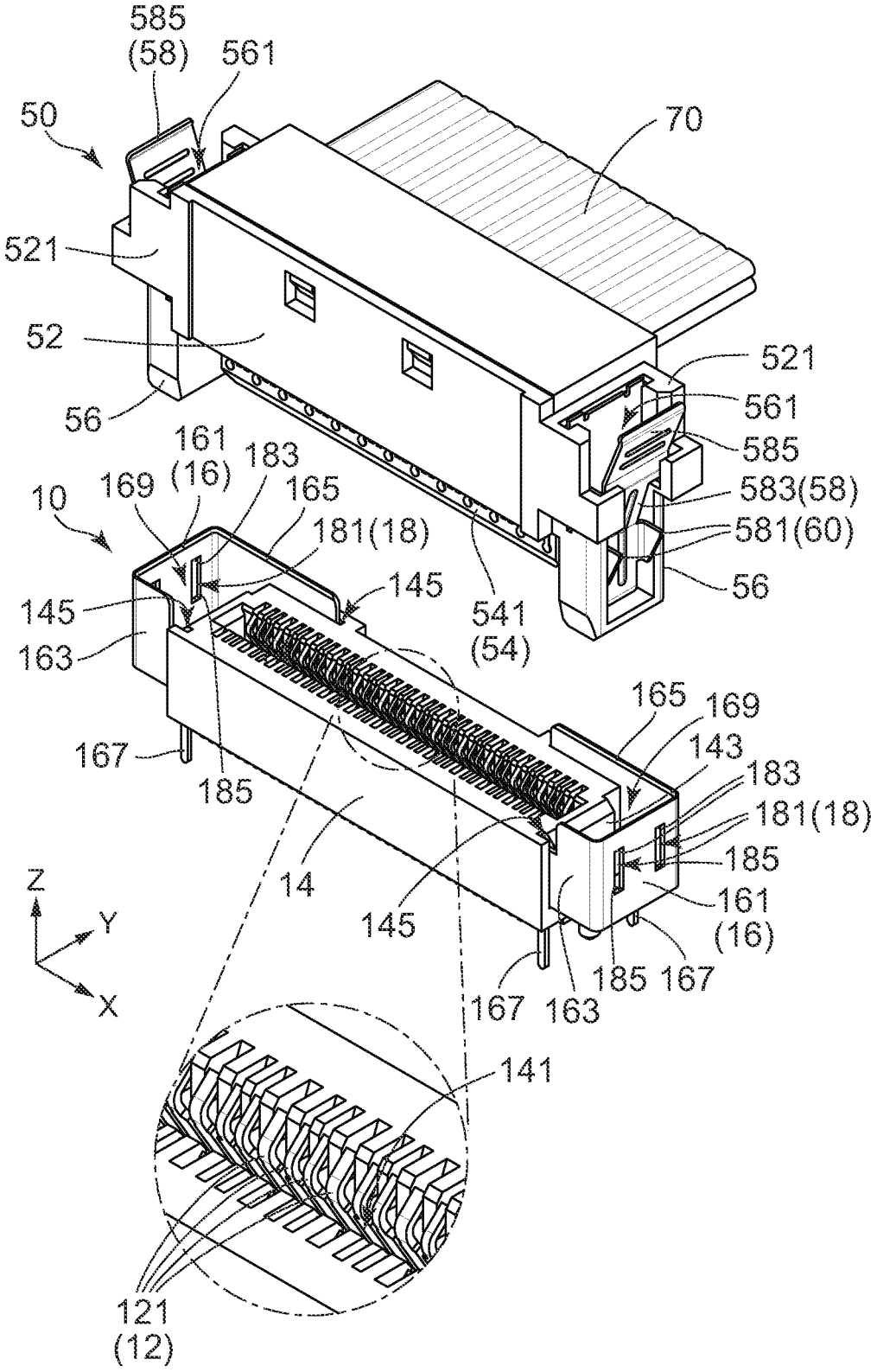
FIG. 1 is a perspective view showing a connector assembly including a connector according to a first embodiment of the present invention. The connector and a mating connector are separated from each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As understood from FIGS. 1 to 4, a connector 10 according to a first embodiment of the present invention is a connector which is mateable with and removable from a mating connector 50 along an up-down direction. In the present embodiment, the connector 10 is a receptacle connector while the mating connector 50 is a plug connector. The connector 10 is mounted on one surface of a substrate 80 in the up-down direction when used. In the present embodiment, the up-down direction is a Z-direction. A positive Z-direction is directed upward while a negative Z-direction is directed downward.

As shown in FIGS. 1. 5 and 6, in the present embodiment, the mating connector 50 is an angle-type connector connected to an end of a flexible flat cable 70. However, the present invention is not limited thereto. The mating connector 50 may be a straight-type connector. Moreover, the mating connector 50 may be connected to a multi-core cable or may be mounted on a mating substrate.

Figure 3:
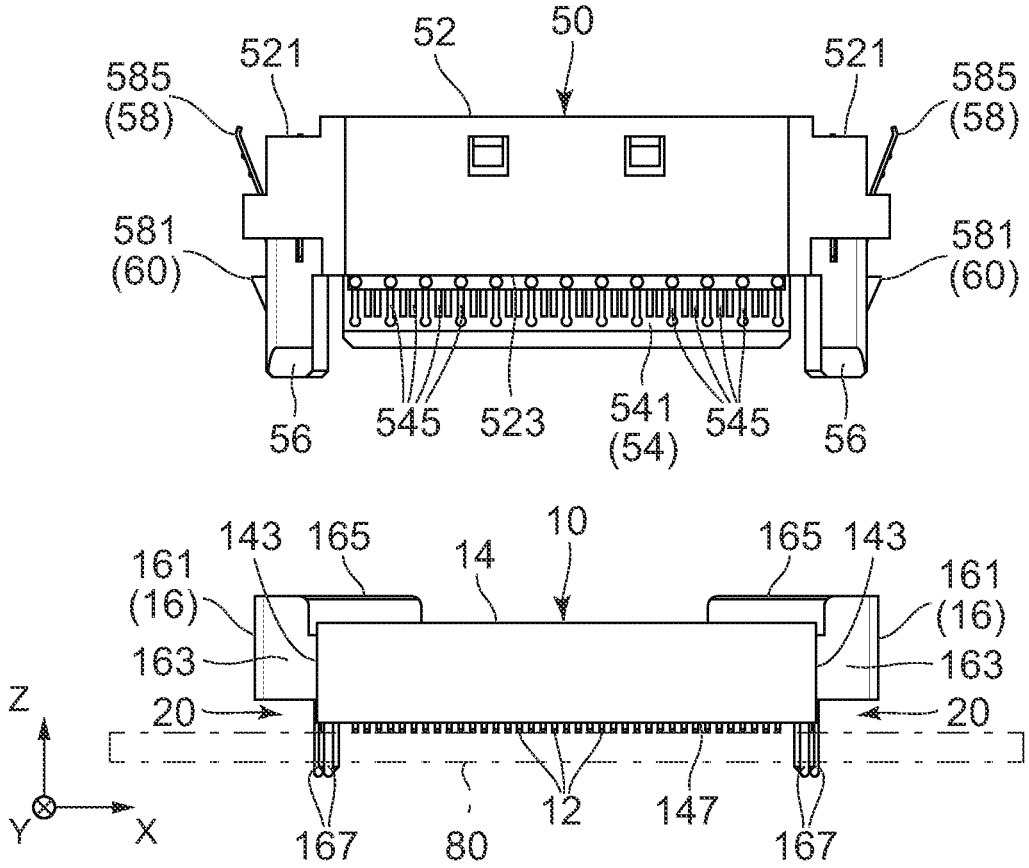
FIG. 3 is a front view showing the connector assembly of FIG. 1.
Figure 5:
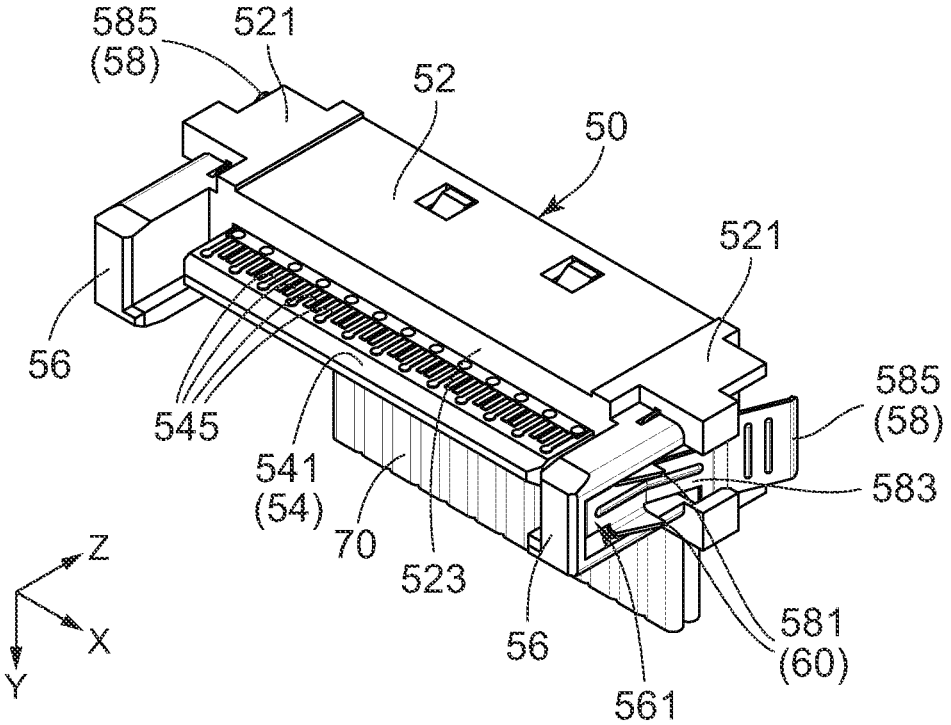
FIG. 5 is a bottom perspective view showing the mating connector included in the connector assembly of FIG. 1.

As shown in FIGS. 3 and 5, the mating connector 50 is provided with a housing body 52, a tongue-shaped portion 54, two protruding blocks 56 and two locking springs 58.

Figure 6:
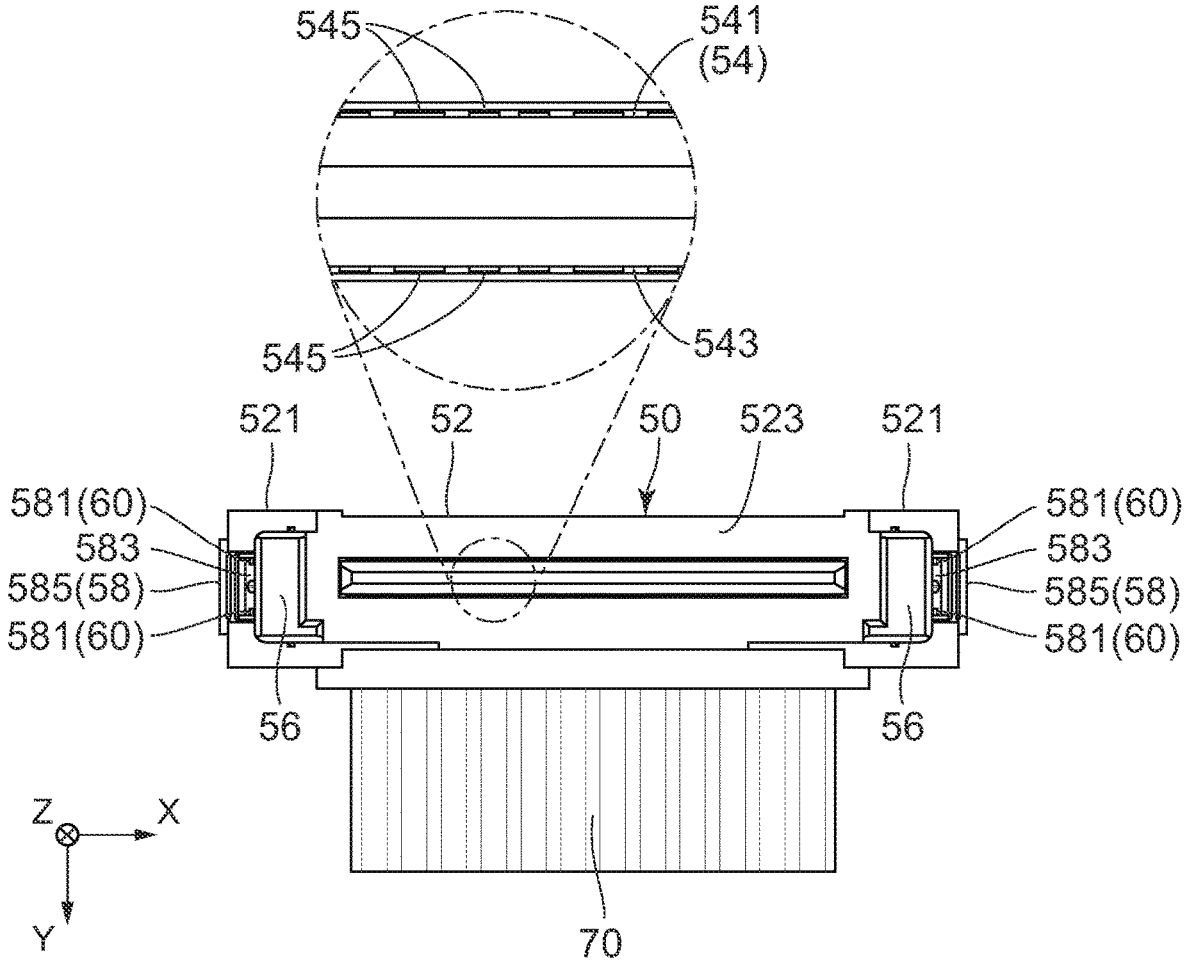
FIG. 6 is a bottom view showing the mating connector of FIG. 5.

As understood from FIGS. 1, 3 and 6, the housing body 52 is made of insulation resin and has an approximately rectangular parallelepiped shape long in a pitch direction. The housing body 52 has locking-spring-holding portions 521 at both ends thereof in the pitch direction. In the present embodiment, the pitch direction is an X-direction.

As shown in FIGS. 3 and 5, the tongue-shaped portion 54 extends in the pitch direction and protrudes downward from a lower surface 523 of the housing body 52. As shown in FIG. 6, each of a front surface 541 of the tongue-shaped portion 54 and a rear surface 543 of the tongue-shaped portion 54 is formed with a plurality of mating contact portions 545 arranged along the pitch direction. In detail, the mating contact portions 545 are conductor pads formed on an insulation substrate. However, the present invention is not limited thereto. The mating connector 50 may be provided with a plurality of metal terminals as a substitute for the tongue-shaped portion 54. At any rate, the mating connector 50 is provided with a plurality of mating contact portions 545.

As shown in FIGS. 3, 5 and 6, the protruding blocks 56 are located apart from each other in the pitch direction. The protruding blocks 56 correspond to the locking-spring-holding portions 521 of the housing body 52, respectively. Each of the protruding blocks 56 protrudes from the locking-spring-holding portion 521 corresponding thereto along the up-down direction. In the present embodiment, the protruding block 56 protrudes downward from the locking-spring-holding portion 521 corresponding thereto. Each of the protruding blocks 56 and the locking-spring-holding portion 521 corresponding thereto define a locking-spring-accommodation portion 561 which opens outward in the pitch direction and upward.

As shown in FIGS. 1 and 5, the locking springs 58 are accommodated in the locking-spring-accommodation portions 561, respectively, in part. In the present embodiment, each of the locking springs 58 is made from a metal sheet and has a pair of stops 581, a supporting portion 583 and an operation portion 585. The supporting portion 583 supports the stops 581 and is resiliently deformable at least in part. Each of the stops 581 protrudes outward in the pitch direction. The operation portion 585 is provided to an end of the supporting portion 583. By operating the operation portion 585, the supporting portion 583 can be resiliently deformed. Resilient deformation of the supporting portion 583 allows the stops 581 to be moved at least in the pitch direction. In an initial state, tip ends of the stops 581 are located outside the locking-spring-accommodation portion 561. The stops 581 of each of the locking springs 58 function as a mating locking portion 60. Thus, each of the protruding blocks 56 is provided with the mating locking portion 60.

Figure 7:
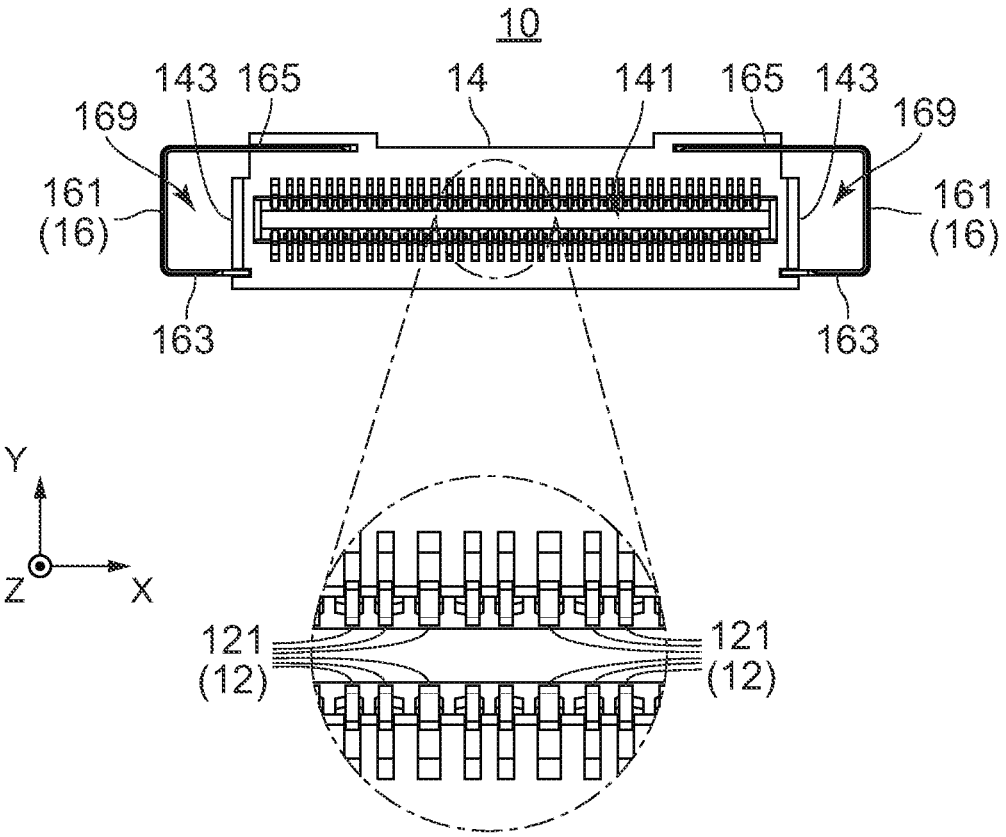
FIG. 7 is a top view showing the connector included in the connector assembly of FIG. 1.
Figure 8:
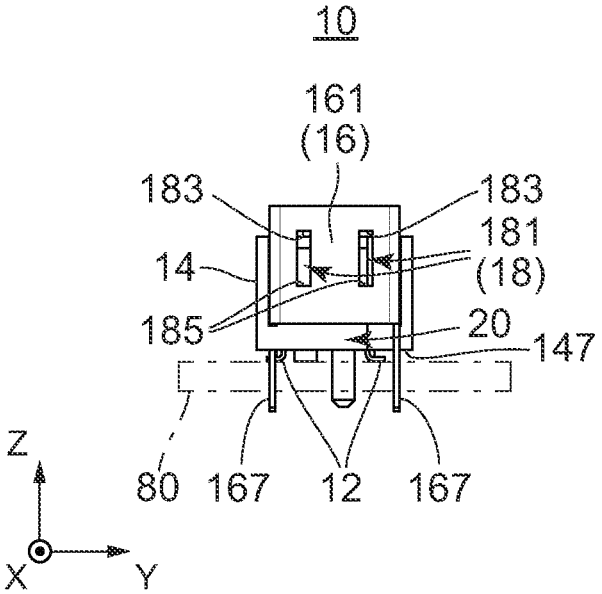
FIG. 8 is a side view showing the connector of FIG. 7.

Referring to FIGS. 1, 7 and 8, the connector 10 is provided with a plurality of terminals 12, two guide members 16 and two locking portions 18.

As shown in FIG. 7, the terminals 12 are arranged in the pitch direction. In the present embodiment, the terminals 12 are arranged in two rows along the pitch direction. However, the present invention is not limited thereto. The terminals 12 correspond to the mating contact portions 545, respectively, and an arrangement of the terminals 12 depends on an arrangement of the mating contact portions 545. For example, the terminals 12 may be arranged in a single row in the pitch direction according to the arrangement of the mating contact portions 545.

As shown in FIGS. 1 and 7, each of the terminals 12 has a contact portion 121, which is brought into contact with the mating contact portion 545 (see FIG. 3 or 5) in a mated state that the connector 10 and the mating connector 50 are mated with each other. In the present embodiment, each of the terminals 12 is a spring contact made of metal. However, the present invention is not limited thereto. In a case where the mating contact portion 545 is a spring contact made of metal, the terminal 12 may be a conductor pad formed on an insulation substrate.

As understood from FIG. 7, the housing 14 holds the terminals 12. The housing 14 has an approximately rectangular parallel piped shape long in the pitch direction and defines an accommodation space 141 which opens upward. Each of the terminals 12 is exposed in the accommodation space 141 in part. In detail, at least the contact portion 121 is exposed in the accommodation space 141.

Figure 9:
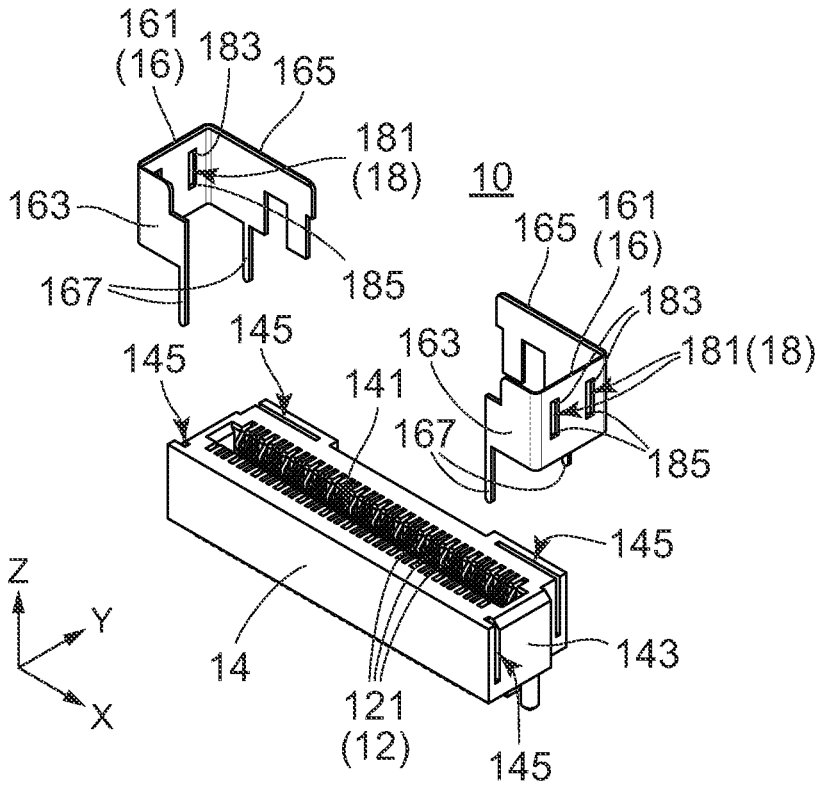
FIG. 9 is an exploded, perspective view showing the connector of FIG. 7.

As shown in FIGS. 7 and 9, the housing 14 has the end faces 143 at both ends thereof in the pitch direction. The end faces 143 of the housing 14 correspond to the protruding blocks 56 (see FIG. 3) of the mating connector 50, respectively. In the present embodiment, each of the end faces 143 is a surface directed outward in the pitch direction.

As shown in FIG. 9, the housing 14 is formed with a plurality of slits 145 to be attached with the guide members 16 and with a plurality of holes (not shown) contiguous to the slits 145. In the present embodiment, each of the slits 145 opens upward and outward in the pitch direction. However, the present invention is not limited thereto. The slit 145 may open only upward according to a shape of the guide member 16 or only outward in the pitch direction.

As understood from FIG. 9, the two guide members 16 are separate and distinct from each other. In the present embodiment, the guide members 16 has shapes which are mirror images of each other. However, the present invention is not limited thereto. The guide members 16 may have the same shapes or different shapes, provided that the guide members 16 correspond to the protruding blocks 56 of the mating connector 50.

As shown in FIGS. 9 to 12, in the present embodiment, each of the guide members 16 is made from a metal sheet and has a side portion 161 and two supporting portions 163 and 165 supporting the side portions 161. The side portion 161 is a flat plate perpendicular to the pitch direction. Each of the supporting portions 163 and 165 is a flat plate extending inward in the pitch direction from an edge of the side portion 161 in a front-rear direction. In the present embodiment, the front-rear direction is a Y-direction. A negative Y-direction is directed forward while a positive Y-direction is directed rearward.

Figure 10:
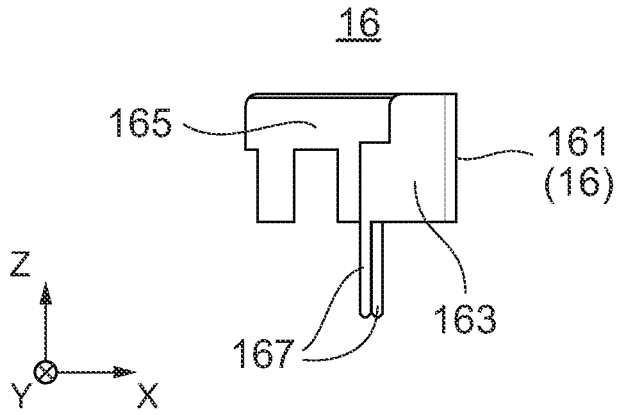
FIG. 10 is a front view showing one of guide members included in the connector of FIG. 9.
Figure 11:
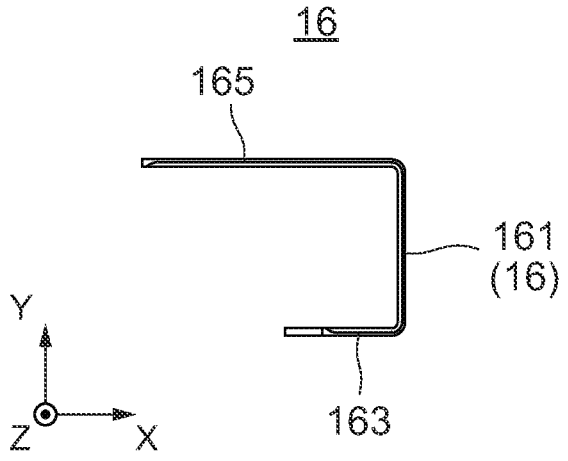
FIG. 11 is a top view showing the guide member of FIG. 10.
Figure 12:
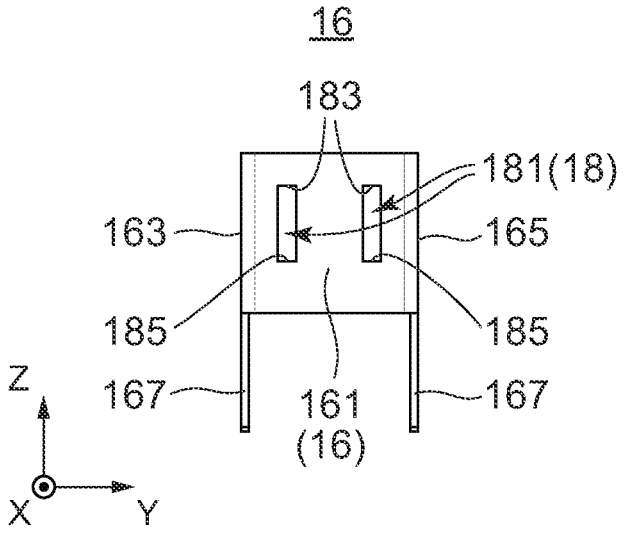
FIG. 12 is a side view showing the guide member of FIG. 10.
Figure 13:
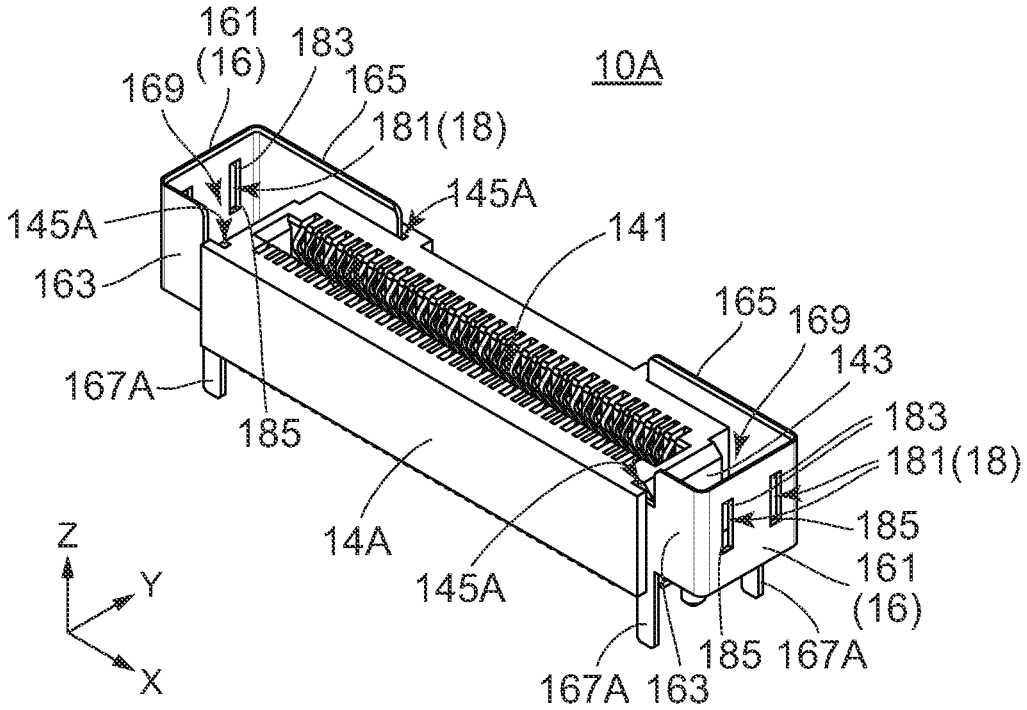
FIG. 13 is a perspective view showing a connector according to a second embodiment of the present invention.
Figure 14:
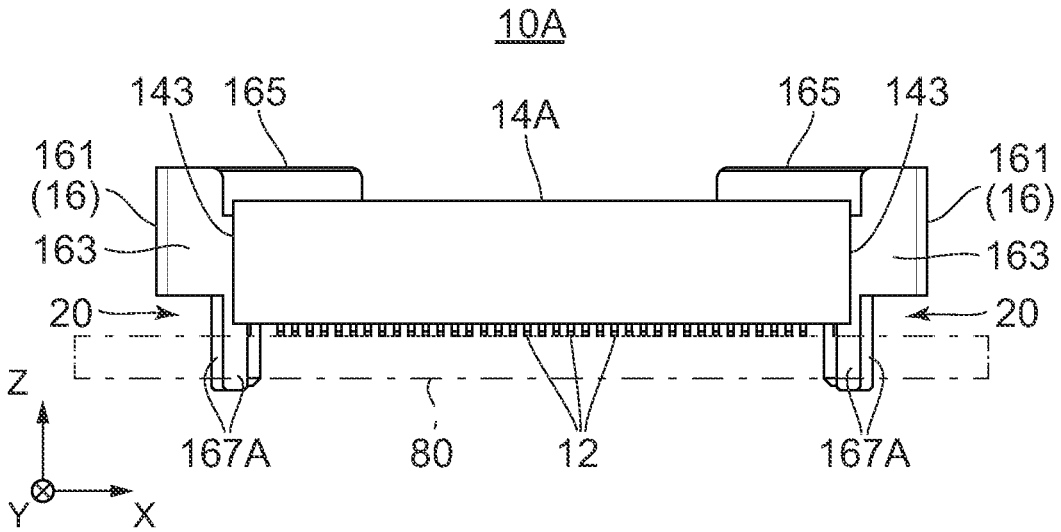
FIG. 14 is a front view showing the connector of FIG. 13.
Figure 15:
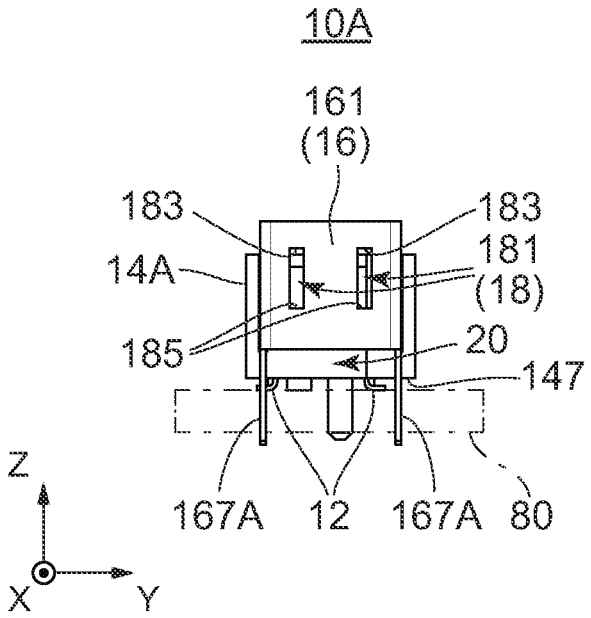
FIG. 15 is a side view showing the connector of FIG. 13.
Figure 16:
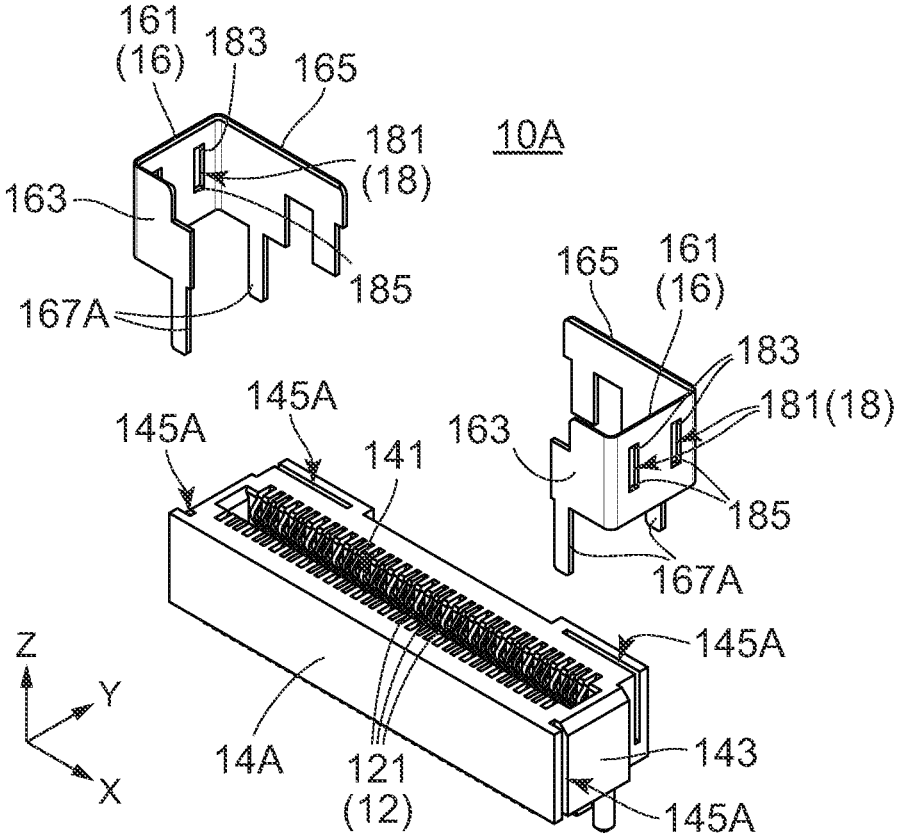
FIG. 16 is an exploded, perspective view showing the connector of FIG. 13.
Figure 17:
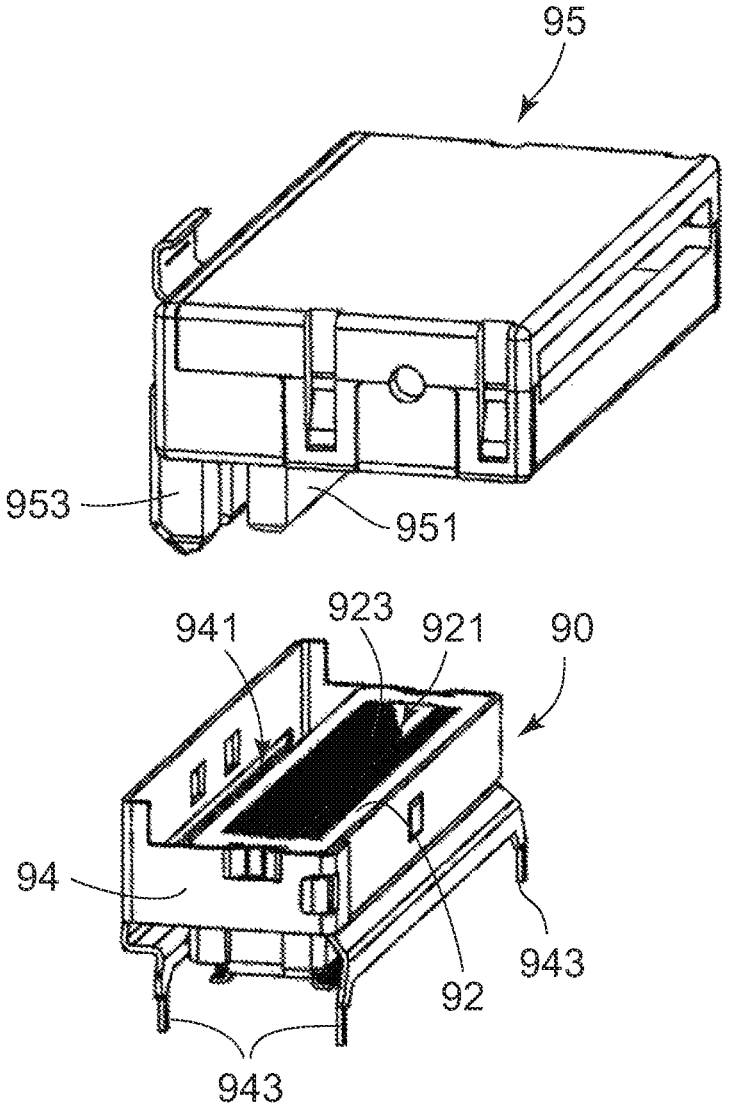
FIG. 17 PRIOR ART
FIG. 17 is a perspective view showing a connector assembly described in Patent Document 1.

As shown in FIGS. 10 to 12, the supporting portions 163 and 165 have lengths different from each other in the pitch direction. Moreover, each of the supporting portions 163 and 165 is provided with leg portions 167 extending downward. However, the present invention is not limited thereto. The supporting portions 163 and 165 may have the same length as each other in the pitch direction. Moreover, each of the supporting portions 163 and 165 may not be provided with the leg portions 167. However, providing at least one leg portion 167 to one or each of the supporting portions 163 and 165 allows the guide member 16 to be directly fixed to the substrate 80 using the leg portion 167.

As understood from FIGS. 7 to 9, the guide members 16 correspond to the end faces 143 of the housing 14, respectively, and thereby the side portion 161 of each of the guide members 16 and the supporting portions 163 and 165 of each of the guide members 16 correspond to one of the end faces 143 of the housing 14. The guide members 16 are attached to both end portions of the housing 14 in the pitch direction. In detail, the supporting portions 163 and 165 are press-fit into the slits 145 of the housing 14, respectively, in part. As understood from FIGS. 3 and 8, at that time, the leg portion 167 provided to the supporting portion 163 is inserted into the hole (not shown) formed in the housing 14 and protrudes downward from a lower surface 147 of the housing 14 in part.

As shown in FIG. 7, in a state that the guide members 16 are attached to the housing 14, the guide members 16 protrude outward from both ends of the housing 14 in the pitch direction. In other words, the side portion 161 of each of the guide members 16 is located apart from the end face 143 corresponding thereto in the pitch direction. The side portion 161, the supporting portions 163 and 165 and the end face 143 corresponding to the side portion 161 form a receiving portion 169. The receiving portion 169 guides and receives the protruding block 56 corresponding to the end face 143 forming the receiving portion 169 when the connector 10 and the mating connector 50 are mated with each other.

As shown in FIG. 1, in the present embodiment, the locking portions 18 correspond to the guide members 16, respectively. In other words, the locking portions 18 are provided to the guide members 16, respectively. As shown in FIG. 12, each of the locking portions 18 is realized as two long holes 181 provided in the side portion 161 of the guide member 16 corresponding thereto. However, the present invention is not limited thereto. The locking portion 18 may be realized as one hole provided in the guide member 16. Alternatively, the locking portion 18 may be realized as one or more holes or recessed portions provided to the housing 14. Furthermore, the locking portion 18 may be realized as at least one protrusion or stop while the mating locking portion 60 may be realized as at least one hole or recessed portion which is engaged with the protrusion or the stop.

As understood from FIG. 12, each of the long holes 181 which serve as the locking portion 18 has an upper end 183 and a lower end 185 in the up-down direction. In other words, the locking portion 18 has a predetermined range defined by the upper ends 183 and the lower ends 185. In the present embodiment, the contact portions 121 of the terminals 12 (see FIG. 1) are located within the predetermined range in the up-down direction. By locating, in the up-down direction, the contact portions 121 of the terminals 12 within the predetermined range defined by the locking portions 18 in this way, a height of the connector 10 can be reduced. In detail, by getting the position of the locking portions 18 down as lower as possible in the up-down direction to locate the contact portions 121 within the predetermined range, the height of the connector 10 can be reduced.

Figure 2:
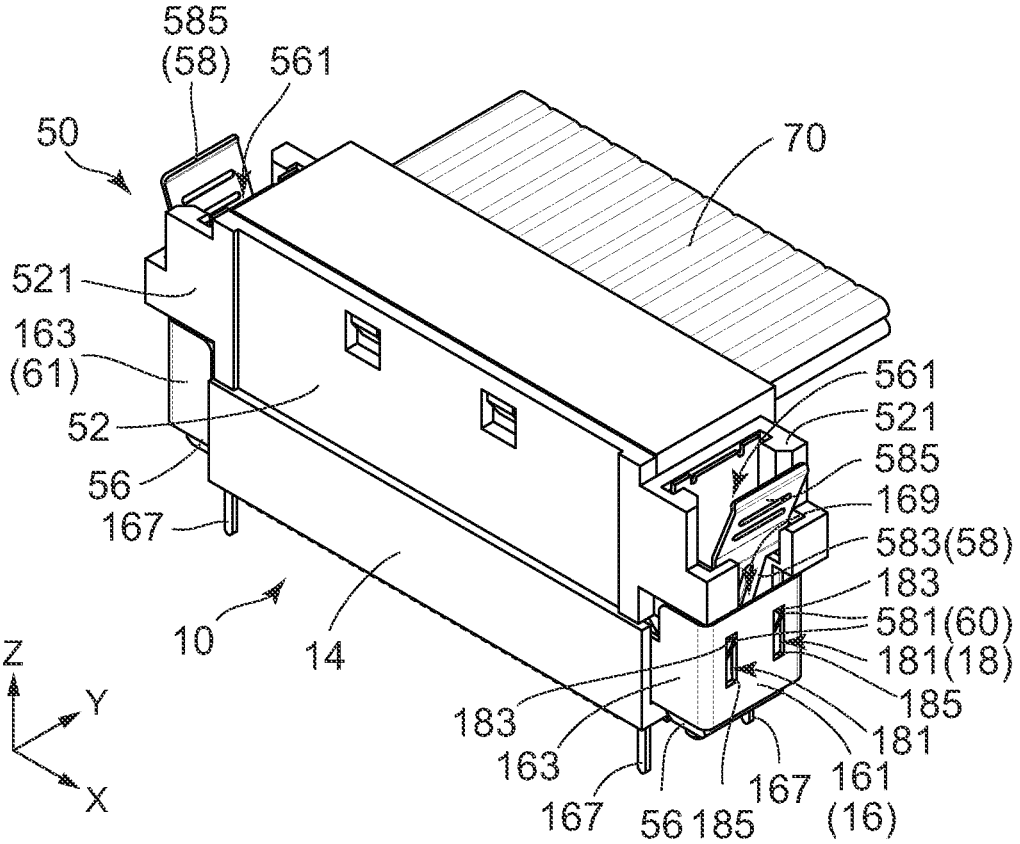
FIG. 2 is another perspective view showing the connector assembly of FIG. 1. The connector and the mating connector are mated with each other.
Figure 4:
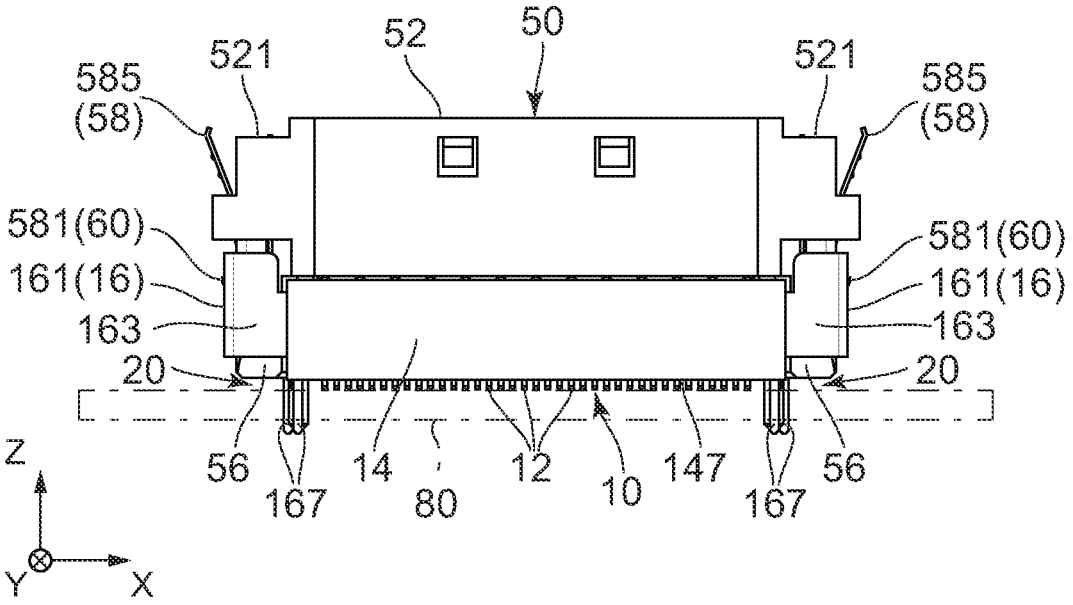
FIG. 4 is a front view showing the connector assembly of FIG. 2.

As understood from FIGS. 2 and 4, in the mated state that the connector 10 and the mating connector 50 are mated with each other, the locking portions 18 lock the mated state together with the mating locking portions 60. In the present embodiment, when the connector 10 and the mating connector 50 are mated with each other, the mating locking portions 60 are received by the locking portions 18 at least in part. Then, the mating locking portions 60 and the locking portions 18 are engaged with one another and lock the mated state. If the operation portions 585 of the locking springs 58 are operated to deform the supporting portions 583 resiliently, the locking of the mated state can be released.

As understood from FIGS. 3 and 4, when the connector 10 is mounted on the substrate 80, the side portion 161 of each of the guide members 16 and the supporting portions 163 and 165 of each of the guide members 16 are located apart from the substrate 80. In detail, the side portion 161 and the supporting portions 163 and 165 are located apart from and upward of the substrate 80 in the up-down direction. Thus, outside each of the end faces 143 of the housing 14 in the pitch direction and under the side portion 161 and the supporting portions 163 and 165 in the up-down direction, a lower space 20 is formed to communicate with the receiving portion 169 (see FIG. 7). Here, the leg portions 167 are located inward of the end faces 143 of the housing 14 at least in part in the pitch direction. Accordingly, the guide members 16 are not located in the lower spaces 20 except for the leg portions 167. In the present embodiment, the whole of the leg portions 167 are located inward of the end faces 143 of the housing 14 in the pitch direction. Therefore, the guide members 16 are not in the lower spaces 20 at all.

According to the present embodiment, since the two guide members 16 are distinct and separated from each other according to the present embodiment, the guide members 16 can be used for housings 14 with various shapes and sizes. In other words, the guide members 16 can be used as common parts for plurality types of connectors.

Moreover, according to the present embodiment, the guide members 16 are not in the lower spaces 20 located downward of the guide members 16. Therefore, conductor patterns can be formed on an area of a mounting surface of the substrate 80 on which the connector 10 is mounted, wherein the area faces each of the lower spaces 20. Thus, the mounting surface of the substrate 80 can be used effectively. Particularly, in a case where a plurality of connectors 10 is mounted on the substrate 80, continuous areas can be formed on the mounting surface of the substrate 80 by arranging the connectors 10 along the front-rear direction to arrange lower spaces 20 in the front-rear direction. And thereby the mounting surface of the substrate 80 can be used more effectively.

Second Embodiment

Referring to FIGS. 13 to 16, a connector 10A according to a second embodiment of the present invention has a structure which is the generally same as the connector 10 according to the first embodiment. However, each of the leg portions 167A of the connector 10A is larger than the leg portion 167 of the connector 10 in size in the pitch direction. Correspondingly, each of the slits 145A of the housing 14A opens downward in the up-down direction in part.

Also in the present embodiment, since the guide members 16A are distinct and separated from each other, the guide members 16A can be used as common parts for plurality types of connectors.

Moreover, the guide members 16A are not located in the lower spaces 20 except for the leg portions 167A. Accordingly, conductor patterns can be formed on an area of a mounting surface of the substrate 80 on which the connector 10A is mounted, wherein the area faces each of the lower spaces 20. Thus, also in the connector 10A according to the present embodiment, the mounting surface of the substrate 80 can be used effectively. Moreover, even if existence of the leg portions 167A is considered, in the present embodiment, the leg portions 167A are located inward of the end faces 143 of the housing 14 in part in the pitch direction. Therefore, the connector 10A allows the mounting surface of the substrate 80 to be used in a relatively effective manner.

Although the specific explanation about the present invention is made above referring to the embodiments, the present invention is not limited thereto but susceptible of various modifications and alternative forms without departing from the spirit of the invention. For example, the housing 14 or 14A may be formed by a housing body and a metal shell or reinforcing metal portion which cover an outside of the housing body in part. In that case, the locking portion 18 may be provided to the metal shell or reinforcing metal portion. Moreover, the guide member 16 may be formed to be attached to the metal shell or reinforcing metal portion.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector which is mateable with a mating connector along an up-down direction, wherein:

the connector is to be mounted on a substrate in the up-down direction;

the mating connector comprises a plurality of mating contact portions and two protruding blocks;

the protruding blocks protrude along the up-down direction;

the protruding blocks are located apart from each other in a pitch direction perpendicular to the up-down direction;

each of the protruding blocks is provided with a mating locking portion;

the connector comprises a plurality of terminals, a housing, two guide members and two locking portions;

the terminals correspond to the mating contact portions, respectively;

each of the terminals has a contact portion which is brought into contact with the mating contact portion corresponding thereto in a mated state that the connector and the mating connector are mated with each other;

the housing holds the terminals;

the terminals are arranged in the pitch direction;

the housing has end faces at both ends thereof in the pitch direction;

the end faces correspond to the protruding blocks, respectively;

the locking portions lock the mated state together with the mating locking portions;

the guide members are distinct and separated from each other;

each of the guide members has a side portion and two supporting portions supporting the side portion;

the guide members correspond to the end faces, respectively, and thereby the side portion and the supporting portions correspond to one of the end faces;

the side portion is located apart from the end face corresponding thereto in the perpendicular direction;

the side portion, the supporting portions and the end face corresponding to the side portion form a receiving portion; and the receiving portion guides and receives the protruding block corresponding to the end face forming the receiving portion when the connector and the mating connector are mated with each other.

2. The connector as recited in claim 1, wherein:

the lock portions correspond to the guide members, respectively; and each of the locking portions is provided to the side portion of the guide member corresponding thereto.

3. The connector as recited in claim 1, wherein the side portion and the supporting portions are located apart from the substrate when the connector is mounted on the substrate.

4. The connector as recited in claim 3, wherein:

each of the guide members further has at least one leg portion to be fixed to the substrate;

the at least one leg portion extends downward from at least one of the supporting portions;

the at least one leg portion is located inward of the end faces of the housing in the pitch direction at least in part;

outside each of the end faces of the housing in the pitch direction and under the side portion and the supporting portions in the up-down direction, a lower space is formed to communicate with the receiving portion; and the guide members are not located in the lower space except for the at least one leg portion.

5. The connector as recited in claim 1, wherein:

each of the locking portions extends over a predetermined range in the up-down direction; and the contact portion of each of the terminals is located within the predetermined range in the up-down direction.

* * * * *